US005441769A

United States Patent [19]

Ross

[11] Patent Number: 5,441,769

[45] Date of Patent: Aug. 15, 1995

[54] PAINT MASK

[76] Inventor: Ryan Ross, by Lorna O. Ross, legal representative, 6718 Lockridge Dr., Doraville, Ga. 30360

[21] Appl. No.: 198,526

[22] Filed: Feb. 17, 1994

[51] Int. Cl.[6] ..... B05D 1/32

[52] U.S. Cl. ..... 427/282; 118/505; 427/284; 428/43

[58] Field of Search ..... 118/504, 505; 427/282, 427/284; 428/43

[56] References Cited

U.S. PATENT DOCUMENTS

| | | | |
|---|---|---|---|
| 1,726,744 | 9/1929 | Krug | 428/261 X |
| 2,672,122 | 3/1954 | Kupec et al. | 118/505 |
| 3,651,783 | 3/1972 | Ribbecke | 118/505 |
| 3,752,304 | 8/1973 | Alef | 206/58 |
| 4,420,520 | 12/1983 | Jones et al. | 428/42 |
| 5,049,445 | 9/1991 | Arvidsson et al. | 156/289 X |
| 5,056,191 | 10/1991 | Love | 16/251 |
| 5,230,738 | 7/1993 | Wheeler | 118/504 |
| 5,242,712 | 9/1993 | Miller | 118/505 X |

OTHER PUBLICATIONS

Glass Mask TM Liquid Masker and Scraper Kit. Wagner Spray Tech Corp. Minneapolis, Minn. 55447. No Date.

E-Z Lift—Protects Windows, Floors and Wood Work When Painting. Made in USA, G-Inc. P.O. Box 28121 Mpls. Minn. 55428, No Date.

The Holiday Etched Glass Series. Static Cling Appliqué. Presto Deco. 110 Center St. Newport, Ky. 41071 ©1990 Kinduell Screen Products, Inc. No Date.

*Primary Examiner*—Michael Lusignan

*Attorney, Agent, or Firm*—Kennedy & Kennedy

[57] ABSTRACT

A paint mask for shielding windows while painting mullions of a window, made of a flexible sheet material having an attractiveness for holding to glass. The paint mask is sized for covering a pane of glass held by mullions. The sheet is engaged flatly to the glass pane to receive paint while the mullion is painted. A method of shielding a glass pane while painting mullions is disclosed.

16 Claims, 1 Drawing Sheet

PAINT MASK

TECHNICAL FIELD

The present invention relates to painting devices. More particularly, the present invention relates to a mask for shielding glass when painting mullions of a window.

BACKGROUND OF THE INVENTION

Wood frame windows typically are used in homes and other buildings to provide a light-transmittal opening in the wall of a building. The windows have a number of uses. The windows communicate light to the interior of the building, open for communicating fresh air, and provide decorative ornamentation for the building.

There are a number of different window styles. One style of window comprises a window frame with a number of small individual panes of glass. The glass is separated by narrow dividers known as mullions. The mullion is a slender member placed between adjacent panes of glass. The mullions each typically include a flange which supports an edge of the pane of glass. The glass pane is held in place by putty, caulk or a narrow strip of wood that covers the outside edge of the glass adjacent the mullion.

While such mullion-style windows are ornamentally attractive, the wood frame and mullion occasionally need repainting. A small brush known as a trim brush typically is used to repaint the frame and the mullions of the window. The small brush provides better control over the application of the paint to the mullions and reduces the application of paint to the windows. Paint which is applied to the windows must be scraped off typically with a razor blade.

Although care can be taken to avoid painting the window pane adjacent the mullion, often some paint is applied to the window pane. As discussed above, the paint is removed by scraping the window with a razor blade in order to provide a trim attractive appearance to the window. Scraping however is laborious and time consuming. Various devices have been provided in the prior art to meet the need of preventing paint from being applied to window panes while painting mullions. Among these devices are a triangular mask with an adhesive strip around the perimeter. The triangular mask is applied to the glass surface and overlapped to cover the entire surface with a portion of the mask. Portions that overlay the mullions would need to be cut off so as not to interfere with the painting of the frames.

Another device provides a flexible narrow blade with a straight edge that contacts the mullion. The ends of the blade are cut at an oblique angle. Two adjacent blades join at a corner of the window. A rubber vacuum cup attaches to each of the blades for securing the blade to the glass.

Another device has a spring clip which engages opposed mullions frictionally. The clip presses a cardboard paint shield firmly against the adjacent window pane.

While these devices have responded to the need for covering glass while painting mullions, drawbacks with these devices limit their usefulness. The triangular shield must be cut to size. Adhesive strips must be applied to a back face during manufacturing. The adhesive strips secure the shield to the glass. Overlaps of triangular sections also leave gaps which can communicate paint to the glass. The blade-style shields are labor intensive requiring accurate positioning of adjacent shields to protect the glass surface. The cardboard shield becomes damp with paint and losses its effectiveness to seal the glass from painting. A spring clamp must be inserted to hold the cardboard sheet to the window.

Accordingly, there is a need in the art for an improved mask for glass to prevent painting the glass while painting mullions.

BRIEF DESCRIPTION OF THE INVENTION

The present invention meets the need in the art by providing a paint mask for windows. The paint mask comprises a planar sheet of a flexible material having an attractiveness for holding to glass. The sheet is sized for covering an entire pane of glass secured to mullions of a window. The sheet is engaged flatly to the glass pane with the edges of the sheet abutted against the putty, caulk or wood trim holding the glass pane to the mullion. The sheet seals to the window firmly to resist dislodgement. The sheet receives overlapping paint while the mullion is painted. This prevents the paint from being applied to the glass.

In another aspect of the invention, one corner of the sheet includes a flap rigidly secured to one corner portion of the sheet. The flap is gripped and pulled in order to remove the sheet from the window pane. The sheet can then readily be repositioned on another pane of the window for continuing the painting of the mullions.

In yet another aspect, the paint mask further comprises a score in a surface of the sheet. The score is parallel to and spaced inwardly from a perimeter edge of the sheet. The sheet can be reduced in size for fitting to a glass pane by severing a perimeter portion of the sheet along the score, to fit conventional sized glass panes.

The present invention further provides a method of sealing a glass window pane from application of paint while painting mullions of a window. A planar sheet of a flexible material having an attractiveness for holding to glass is placed on a glass pane framed by mullions of a window. The edges of the sheet abut against a trim material that holds the glass pane to the mullion. The sheet, being engaged flatly to the glass pane, receives overlap paint while the mullion is painted, preventing paint from being applied to the glass.

The method further comprises a step of squeezing air bubbles from between the sheet and the glass pane for sealingly engaging the sheet to the glass pane. The method further comprises a step of sizing the sheet to fit the glass pane by severing a perimeter area of the sheet along a score.

Objects, advantages, and features of the present invention will become apparent from reading the following detailed description of the invention and the claims in view of the appended drawings.

DETAILED DESCRIPTION OF THE INVENTION

Figure 1:
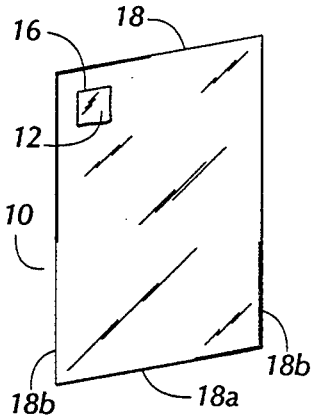
FIG. 1 is a perspective view of a paint mask according to the present invention.

Referring now in more detail to the drawings, in which like numerals indicate like parts throughout the several views, FIG. 1 shows a perspective view of a paint mask 10 for windows according to the present invention. The paint mask 10 comprises a planar sheet of a flexible material having an attractiveness for holding to glass. The paint mask 10 includes a tab 12 in a corner portion 16 and a perimeter edge 18. The tab 12 preferably attaches to the sheet 10 with an adhesive. A preferred adhesive is DURO Non-Flammable Fast Drying Contact Cement made by Lactite Corporation of Cleveland, Ohio. The mating surfaces of the sheet 10 and the tab 12 are preferably toughened before joining. In the illustrated embodiment, the tab 12 is made of the same material as the mask 10.

The paint mask 10 has an affinity for self-adhering to glass. In a preferred embodiment, the attractiveness for holding to glass is thought to arise by electrostatic attraction or by surface tension of the paint mask to the glass. The paint mask 10 is removable from the glass by peeling the edge 18 away from the glass. During normal use, however, the brush strokes of a paint brush over the mullion and the paint mask 10 would not dislodge the mask from sealing contact with the glass.

Figure 2:
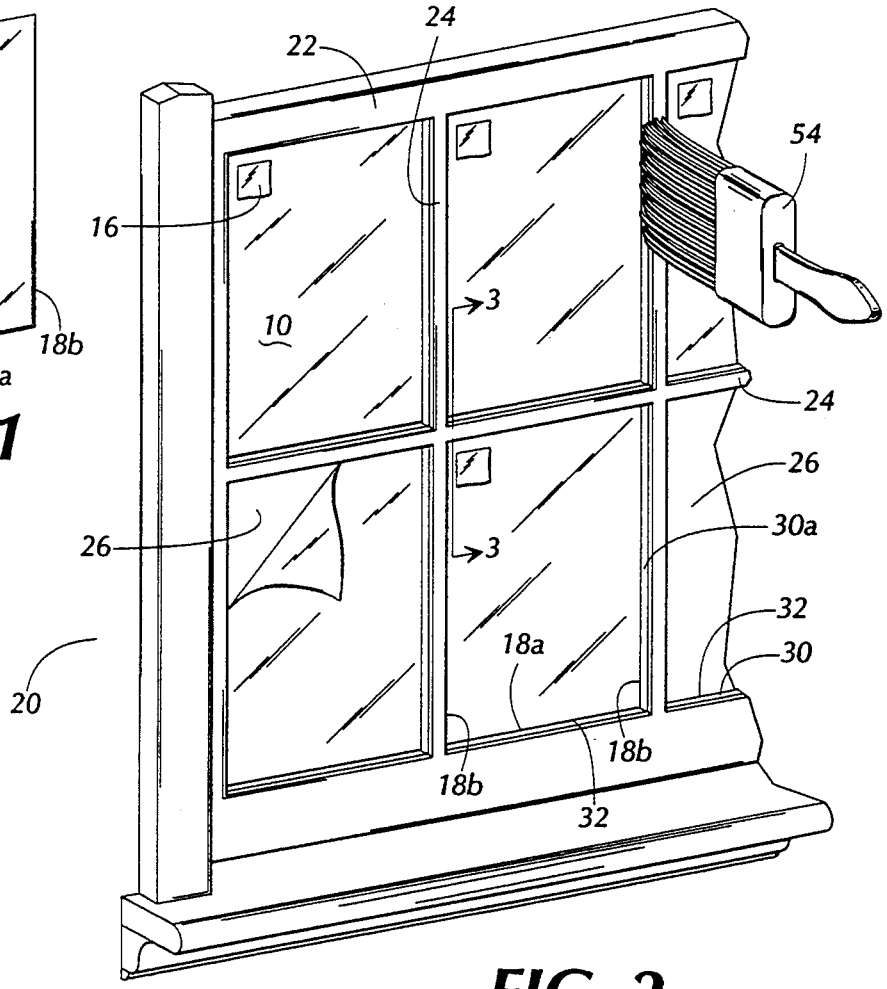
FIG. 2 is a perspective view of a window with panes separated by mullions, with paint masks as shown in FIG. 1 applied to the window panes for painting the mullions.
Figure 3:
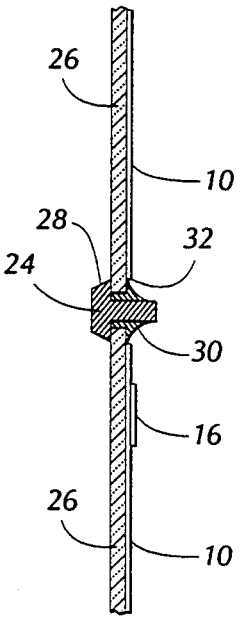
FIG. 3 is a side view of the window shown in FIG. 2.

FIG. 2 illustrates a perspective view of a window 20 in a frame 22. The window 20 includes vertical and horizontal mullions 24 which define receiving areas for panes 26 of glass. As best illustrated in side view in FIG. 3, the glass panes 26 are held on respective flanges 28 of the mullions 24. A putty, caulk, or wood trim 30 secures the glass panes 26 in place.

Figure 4:
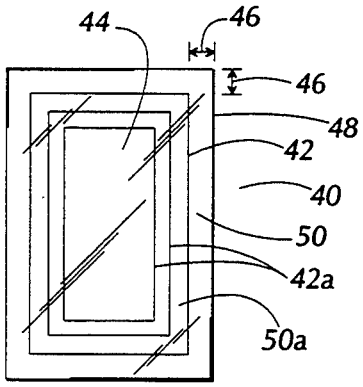
FIG. 4 is a plan front view of an alternate embodiment of the paint mask illustrated in FIG. 1.

FIG. 4 is an alternate embodiment 40 of the paint mask 10 illustrated in FIG. 1. This embodiment 40 would include at least one score 42 in a face surface 44 of the paint mask 40. The score 42 is inwardly spaced a predetermined distance 46 from a perimeter edge 48 of the paint mask 40. The score 42 defines a perimeter area 50 on the edge portion of the paint mask 40. The score 42 extends into the paint mask 10 but not through the paint mask 10. Other scores **42*a* are spaced inwardly predetermined distances from the edge 48. These scores 42*a* each define perimeter areas 50*a* around the edge of the paint mask 40. The scores 42 are parallel to the edge 48 of the paint mask 40. The scores 42 provide lines for severing the perimeter area 50 to make the paint mask 10 have a selected size. In this embodiment, the paint mask can be trimmed to pre-defined dimensions for use with conventional size mullion windows. The scores 42** preferably are spaced apart on one-half inch intervals.

The paint mask 10 illustrated in FIG. 1 is used to seal the glass pane 26 from paint while painting the mullions 24. Mullion-style windows are conventionally found in standard sizes. The paint mask 10 is pre-cut to one of the conventional size window panes. For the alternate embodiment of the paint mask 40 shown in FIG. 4, the paint mask is cut to size by severing the perimeter area 50 along a selected one of the scores 42. The remaining discussion regarding the paint mask 10 relates to the paint 40 after sizing as discussed above.

The paint mask 10 is then applied to the window. A lower edge **18*a* of the paint mask 10 is positioned against the trim 30 at a lower edge 32 of the glass pane 26. The paint mask 10 is positioned on the pane so that the lateral edges 18*b* contact the trim 30*a* on the sides of the glass pane 26. The paint mask 10 then is pushed onto the face of the glass pane 26 while maintaining the edges 18 closely against the trim 30. The perimeter edge 18 of the glass mask 10 is thus pressed against the glass pane 26 adjacent the trim 30 to assure sealing contact with the glass pane adjacent the mullion. It is preferred that the glass pane 26 be clean before placing the paint mast 10. A roller may be used to push air bubbles trapped between the paint mask 10 and the glass pane to the edges of the paint mask. The mullion 24 is then painted with a conventional paint brush 54 and paint. During painting the brush strokes may overlap the paint mask 10 which receives paint. The sealing contact between the paint mask 10** and the glass pane restricts passage of paint underneath the paint mask onto the glass.

After the mullion 24 is painted, the paint mask 10 is removed and placed on another glass pane 26 for painting another mullion. The paint mask 10 is removed by gripping the tab 12 and pulling laterally. This separates the corner portion 16 of the paint mask 10 from the window pane 26. The paint mask 10 is pulled outwardly from the window. The paint mask 10 then is placed on another pane for painting mullions, as discussed above.

A sheet of smokey-colored PVC vinyl was purchased at Hancock Fabric Stores in Atlanta, Ga. The vinyl had a thickness of 0.013 inches. The sheet was cut to form a paint mask 10 having a size of 7.75 inches by 9.4 inches. A one-inch square of the vinyl was cut and affixed to the corner portion 16 of the sheet 10. The adhesive was DURO Non-Flammable Fast-Drying Contact Cement. The smokey-colored PVC sheet was then placed on the glass pane with the edges abutted against the caulk holding the glass pane to a mullion of a window. The mullion was then painted. The paint mask was removed from the window. Paint from the paint brush had been applied to the paint mask. The paint was not overlaid on the glass pane. No scraping was needed.

Another sheet of PVC vinyl was purchased. This sheet was clear and had a thickness of 0.010 inches. The sheet was made by Nanya Plastics Corporation of Taiwan. The product number was 73895-5. A paint mask 10 was cut to size as described above. The clear paint mask was placed on a glass pane of a window. The edges of the sheet were abutted against the caulk holding the glass pane to the mullion. This paint mask made of a thinner PVC sheet did not attach to the glass pane as well as the paint mask made from the smokey-colored sheet had attached. Air bubbles were observed trapped between the paint mask and the glass pane. Portions of the edges of the paint mask did not appear to be in sealing contact with the glass pane against the caulk. A squeegee was rolled across the paint mask to drive the air bubbles out and to secure the edges of the paint mask. It was considered that the thinner paint mask would work satisfactorily for preventing application of paint to the glass pane during painting.

The principles, preferred embodiments, and modes of operation of the present invention have been described in the foregoing specification. The invention is not to be construed as limited to the particular forms disclosed because these are regarded as illustrative rather than restricted. Moreover, variations and changes may be made by those skilled in the art without departing from the spirit of the invention as described by the following claims.

What is claimed is:

1. A method of sealing a glass window pane from application of paint while painting mullions of a window, comprising:

placing on a glass pane framed by mullions of a window a planar sheet of a flexible material having an attractiveness for holding to glass; and abutting edges of the sheet against a trim material holding the glass pane to the mullion, whereby the sheet, being engaged flatly to the glass pane, receives overlap paint while the mullion is painted, preventing paint from being applied to the glass.

2. The method of sealing as recited in claim 1, further comprising a step of squeezing air bubbles from between the sheet and the glass pane for sealingly engaging the sheet to the glass pane.

3. The method of sealing as recited in claim 1 further comprising a step of sizing the sheet to fit the glass pane by severing a perimeter area of the sheet along a score spaced inwardly from a perimeter edge of the sheet.

4. The method of sealing as recited in claim 1, further comprising a step of removing the sheet from the glass pane after painting the mullion by pulling on a tab attached to an outer surface of the sheet.

5. The method of sealing as recited in claim 4, further comprising repeating the steps of placing, abutting, and removing the sheet on windows to be painted.

6. A method of sealing a glass window pane from application of paint while painting mullions of a window, comprising:

placing on a glass pane framed by mullions of a window a planar sheet of a flexible material having an attractiveness for holding to glass the planar sheet and having a thickness of about 0.013 inches; and abutting edges of the sheet against a trim material holding the glass pane to the mullion, whereby the sheet, being engaged flatly to the glass pane, receives overlap paint while the mullion is painted, preventing paint from being applied to the glass.

7. The method as recited in claim 6, further comprising a step of squeezing air bubbles from between the sheet and the glass pane for sealingly engaging the sheet to the glass pane.

8. The method as recited in claim 6, further comprising a step of sizing the sheet to fit the glass pane by severing a perimeter area of the sheet along a score.

9. The method of sealing as recited in claim 6, further comprising a step of removing the sheet from the glass pane after painting the mullion by pulling on a tab attached to an outer surface of the sheet.

10. The method of sealing as recited in claim 9, further comprising repeating the steps of placing, abutting, and removing the sheet on windows to be painted.

11. A masking method of masking a glass window pane from inadvertent application of paint while painting mullions of a window, comprising:

affixing a flexible sheet to a surface of a glass window pane, the flexible sheet including nonadhesive for attractively holding the sheet to the glass window pane;

abutting perimeter edges of the flexible sheet against respective mullions of a window; and pressingly contacting a perimeter portion of the flexible sheet to secure same against the glass window pane adjacent the mullion for sealingly closing a gap between the glass window pane and the flexible sheet, whereby painting the mullion applies overlap paint to an exposed surface of the flexible sheet.

12. The masking method as recited in claim 11, further comprising sizing the flexible sheet for closely fitting on the glass window pane in abutment with the mullions.

13. The masking method as recited in claim 12, wherein sizing comprises severing a perimeter area of the flexible sheet.

14. The masking method as recited in claim 13, wherein severing comprises separating a perimeter area along a score spaced inwardly from a perimeter edge of the flexible sheet.

15. The method of sealing as recited in claim 11, further comprising a step of removing the sheet from the glass window pane after painting the mullion by pulling on a tab attached to an outer surface of the sheet.

16. The method of sealing as recited in claim 15, further comprising repeating the steps of placing, abutting, and removing the sheet on windows to be painted.

* * * * *